United States Patent [19]

Caraballo

[11] Patent Number: 5,024,619

[45] Date of Patent: Jun. 18, 1991

[54] TERMINAL CONNECTOR ASSEMBLY

[76] Inventor: Damian F. Caraballo, 1250 Chorus Way, Royal Palm Beach, Fla. 33411

[21] Appl. No.: 601,446

[22] Filed: Oct. 22, 1990

Related U.S. Application Data

[63] Continuation-in-part of Ser. No. 394,128, Aug. 15, 1989, Pat. No. 4,964,819.

[51] Int. Cl.[5] ..... H01R 13/631

[52] U.S. Cl. ..... 439/755; 439/773

[58] Field of Search ..... 439/754, 769, 772–774, 439/755, 770

[56] References Cited

U.S. PATENT DOCUMENTS

| | | | |
|---|---|---|---|
| 1,868,939 | 7/1932 | Conrad | 439/769 |
| 2,589,122 | 3/1952 | Olson | 439/756 |
| 2,706,284 | 4/1955 | Hoggatt et al. | 439/772 |
| 3,084,306 | 4/1963 | Cribbs | 439/773 |
| 3,644,876 | 2/1972 | Thomas | 439/524 |
| 3,694,799 | 9/1972 | Shannon et al. | 439/726 |
| 4,537,460 | 8/1985 | McCaig | 439/773 |
| 4,747,793 | 5/1988 | Fukuda et al. | 439/754 |

FOREIGN PATENT DOCUMENTS

| | | | |
|---|---|---|---|
| 605717 | 9/1960 | Canada | 439/773 |
| 722313 | 11/1965 | Canada | 439/773 |
| 572866 | 9/1977 | U.S.S.R. | 439/773 |

*Primary Examiner*—Gary F. Paumen

*Attorney, Agent, or Firm*—Eckert Seamans Cherin & Mellott

[57] ABSTRACT

A battery terminal connector includes a rotatable member having a first inclined surfaced offset from the axis of rotation and a fixed member with a second inclined surface. Rotation of the rotatable member relative to the fixed member causes contact between the first inclined surface and the second inclined surface to press the battery cable terminal to the battery terminal.

8 Claims, 4 Drawing Sheets

TERMINAL CONNECTOR ASSEMBLY

BACKGROUND OF THE INVENTION

1. Cross Reference to Related Application

This application is a continuation-in-part of Applicant's co-pending application Ser. No. 394,128 filed Aug. 15, 1989, now U.S. Pat. No. 4,964,819.

1. Field of the Invention

This invention relates generally to battery connectors, and more particularly to battery terminal post connectors for top post terminal and side post terminal batteries.

3. Description of the Relevant Art

Battery conductor cables typically are attached to the battery terminal top posts by a terminal connector clamp. The top post terminal connector clamp has a base that is electrically connected to an end of the battery conductor cable. The terminal connector clamp has opposing terminal connector flanges with aligned apertures adapted to receive a bolt. Inner, curvilinear surfaces can be provided on the terminal connector flanges to engage the generally cylindrical terminal posts. A nut is threaded onto the bolt to force the terminal connector flanges against one another to engage the terminal post. Side post terminal batteries typically have female fittings at the terminals which receive bolts. The bolts are positioned through apertures in the battery cable terminals to secure the cable terminals to the battery post terminals.

Present terminal connectors are messy and difficult to use in practice. The tightening bolt or nut often becomes frozen in place and sometimes is partially embedded in the soft lead of the terminal connector flange. It is difficult to fit a wrench onto the tightening nut or bolt, which often becomes worn or corroded, and frequently is located in close quarters where wrenches are not easily usable. Properly sized wrenches and tools are sometimes not available to adequately grip the bolt and tightening nut. In any event, several turns of the nut or bolt are often necessary to sufficiently loosen or tighten the terminal connector clamp.

It would be desirable to provide a battery terminal connector which would allow quick connection and disconnection of conductor cables to lead storage cell batteries. It would further be desirable if such a device would not require the use of a wrench or other tool. It would additionally be desirable that such a device be easily installed in existing conductor cable constructions, which could be adapted for top post terminal or side post terminal batteries, and which could be used reversibly on either the positive or negative terminals of the battery.

SUMMARY OF THE INVENTION

It is an object of the invention to provide a terminal connector assembly which will permit the ready connection and disconnection of electrical conductor cables to batteries, and particularly batteries with top post and side post terminals.

It is another object of the invention to provide a terminal connector assembly which can be easily and quickly clamped or released and which will not require the use of a wrench or other hand tools to connect or disconnect the terminal connector to the terminal post of the battery.

It is yet another object of the invention to provide a terminal connector assembly which can be reversibly used on either the positive or negative terminal of the battery.

It is another object of the invention to provide a terminal connector assembly which will resist corrosive damage.

It is yet another object of the invention to provide a terminal connector assembly in which existing terminal connectors can be readily modified to that of the invention.

These and other objects are accomplished by a rotatable member having a first inclined surface offset from the axis of rotation. A fixed member has a second inclined surface which cooperates with the first inclined surface of the rotatable member to press the battery cable terminal to the battery terminal. Terminal connector clamps for top post terminals have opposing, first and second terminal connector flanges. The terminal connector flanges have aligned apertures for the reception of a bolt that is adapted to press the opposing flanges together to engage the terminal post of the battery. According to the invention, a connecting shaft having a long axis is adapted for placement through the apertures. The connecting shaft has, at one end, a stop adapted to engage an outside surface of a first connector flange. The rotatable member, preferably a lever, is operatively connected to substantially an opposite end of the connecting shaft, and is rotatable substantially about the long axis of the connecting shaft. The fixed member is positioned at an outside surface of the second connector flange and can be attached to, embedded within, or cast with the second connector flange. The second inclined surface is substantially juxtaposed to the first inclined surface of the lever member. Rotation of the lever member relative to the fixed member will cause sliding contact between the first inclined surface and the second inclined surface, and axial movement of the fixed member relative to the lever member along the long axis of the connecting shaft. This will press the terminal connector flanges between the stop and the fixed member to tighten the connector flanges around the terminal post.

In a preferred embodiment, the lever member has a mounting aperture adapted to receive the connecting shaft. An end of the connecting shaft has a head dimensioned to prevent passage through the mounting aperture, such that the lever member will be rotatably mounted to the connecting shaft. The fixed member can also have a mounting aperture adapted to receive the connecting shaft. The fixed member abuts and engages the second terminal connector flange. Rotation of the lever member will cause sliding contact between the first inclined surface of the lever member and the second inclined surface of the fixed member. The fixed member and second connector flange will be axially advanced along the axis of the connecting shaft toward the stop and will tighten the connector flanges about the terminal post.

The stop is preferably detachable from the connecting shaft. The shaft can have male threads substantially at one end. The stop can be provided as a knurled nut having a mounting aperture with female threads adapted to cooperatively engage the male threads of the connecting shaft. The stop member can thereby be threadably engaged to the connecting shaft, and its position on the connecting shaft can be adjusted to provide a coarse adjustment with respect to the terminal connector flanges. The stop member can also thereby be removed to permit attachment and replacement of the connecting shaft through the aligned apertures.

A second embodiment of the invention is suitable for batteries having side post terminals with female fittings. A lever has an aperture substantially at one end thereof for the passage of a battery cable connector bolt, which is dimensioned to engage the battery terminal fitting. The lever has a first inclined surface. A battery cable terminal has an aperture therethrough adapted to permit the passage of the connector bolt, and has a second inclined surface. The connector bolt is passed through the apertures of the lever and the battery cable terminal, and is engaged to the battery terminal with the first inclined surface of the lever substantially juxtaposed and angularly offset from the second inclined surface of the battery cable terminal. Rotation of the lever about the connector bolt will cause sliding contact between the first inclined surface of the lever and the second inclined surface of the battery cable terminal to firmly press the battery cable terminal against the battery terminal.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
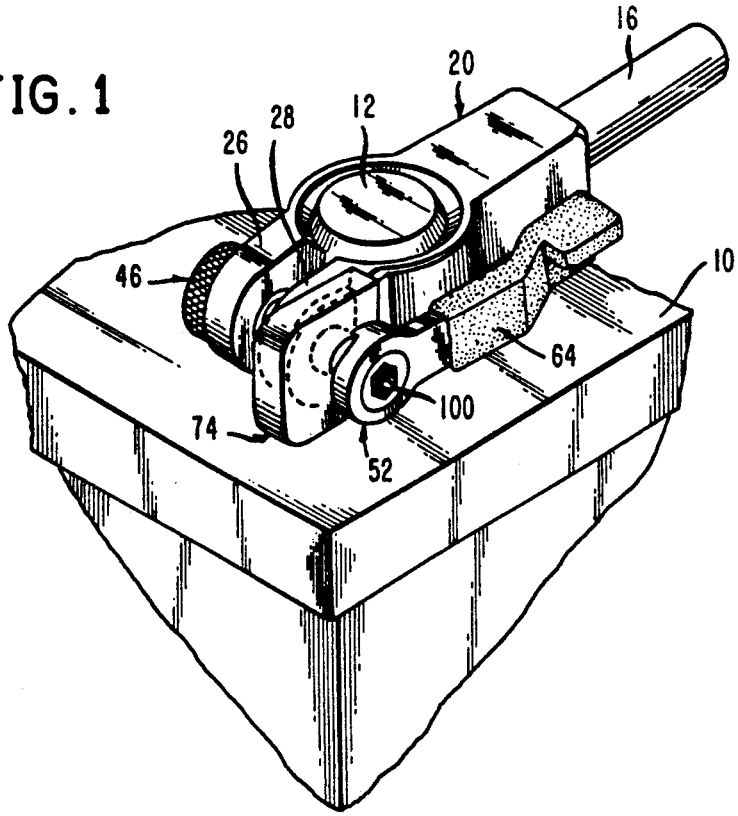
FIG. 1 is a perspective view of a top post terminal connector assembly according to the invention.
Figure 2:
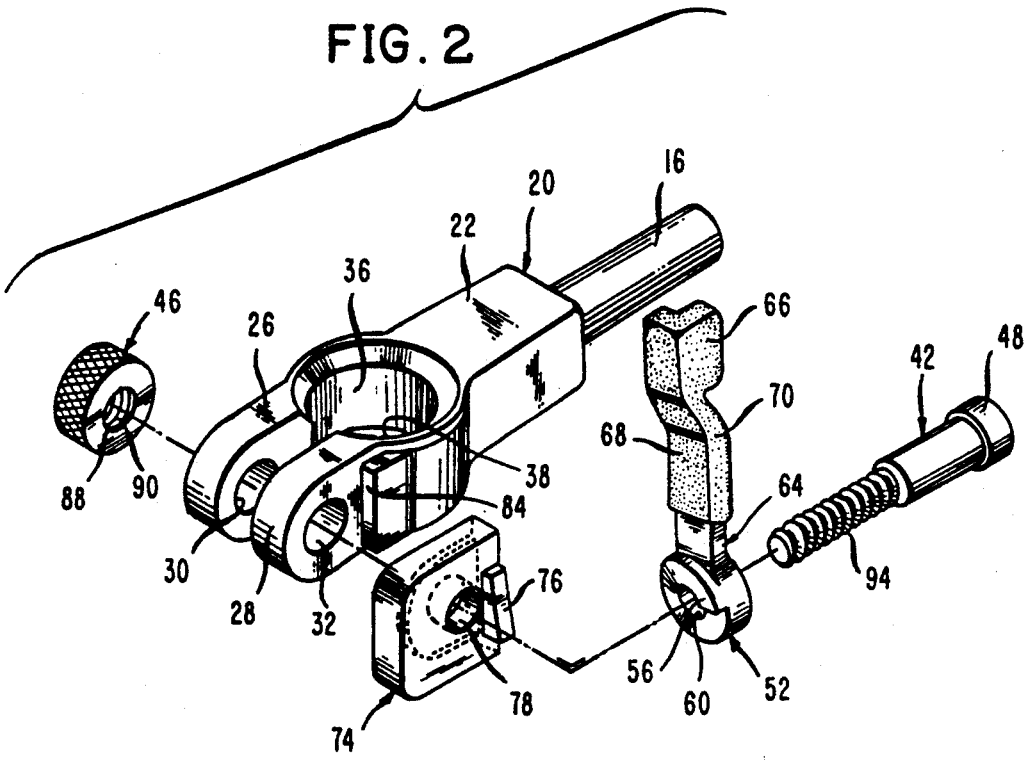
FIG. 2 is an exploded perspective of a top post terminal connector assembly according to the invention.

There are shown in FIGS. 1–4 a terminal connector assembly according to the invention. The invention can be utilized with several alternative electrical connections and battery constructions having top post terminals, but most typically will be used with a lead storage cell battery 10. The lead storage cell battery 10 typically includes a terminal post 12, which is commonly cylindrical and can be either the anode or the cathode of the battery. An electrical conductor cable 16 will normally be provided for electrical connection of the battery 10 with remaining portions of the motor or engine. A terminal connector clamp 20 is provided at an end of the conductor cable 16 for engaging the terminal post 12.

The terminal connector clamp 20 typically includes a base 22 which is electrically connected to the conductor cable 16. Opposing first and second terminal connector flanges 26, 28 respectively, are joined to the base 22. The opposing first terminal connector flange 26 and second terminal connector flange 28 can have substantially aligned apertures 30, 32 respectively, which are provided for the reception of fastening means such as a nut and bolt for pressing the flanges together against the terminal post 12. Inner curvilinear surfaces 36, 38 can be formed on the first and second terminal connector flanges 26, 28 for securely engaging the terminal post 12.

According to the invention, the nut and bolt of terminal connector clamps are replaced by a connecting shaft 42 and stop member 46. The connecting shaft 42 is adapted to be positioned through the apertures 30, 32. The stop member 46 is secured to a first end of the connecting shaft 42, and a head 48 can be provided as a stop means at an opposite end of the connecing shaft 42.

A rotatable member 52, preferably a lever, is mounted to the connecting shaft 42 so as to be rotatable about the long axis defined by the connecting shaft 42. The rotatable lever member 52 has a first inclined surface 56, which is preferably substantially circular. A mounting aperture 60 is provided for the passage of the connecting shaft 42. A lever arm 64 can be constructed with a bend 70 which will allow the lever arm to snugly fit the profile of the terminal connector clamp 20. The lever arm 64 is provided to facilitate rotation of the rotatable member 52 about the long axis of the connecting shaft 42. A tab portion 66 can be provided for a better grip. The lever arm 64 can also include an insulating covering 68 to provide a better grip, and to prevent accidental shorting. The insulating covering 68 can be color-coded to indicate electrical polarity such as black for the negative terminal, and red for the positive terminal.

A fixed member 74 includes a second inclined surface 76. The fixed member 74 can be fixed to be embedded within or cast with the second terminal connector flange 28. The fixed member 74 most preferably includes a mounting aperture 78 which is adapted to receive the connecting shaft 42. Many terminal connector flanges have a recess 84 formed in one or both of the terminal connector flanges, and the fixed member 74 can be adapted to fit into and engage this recess to prevent rotation of the fixed member 74.

Figure 3:
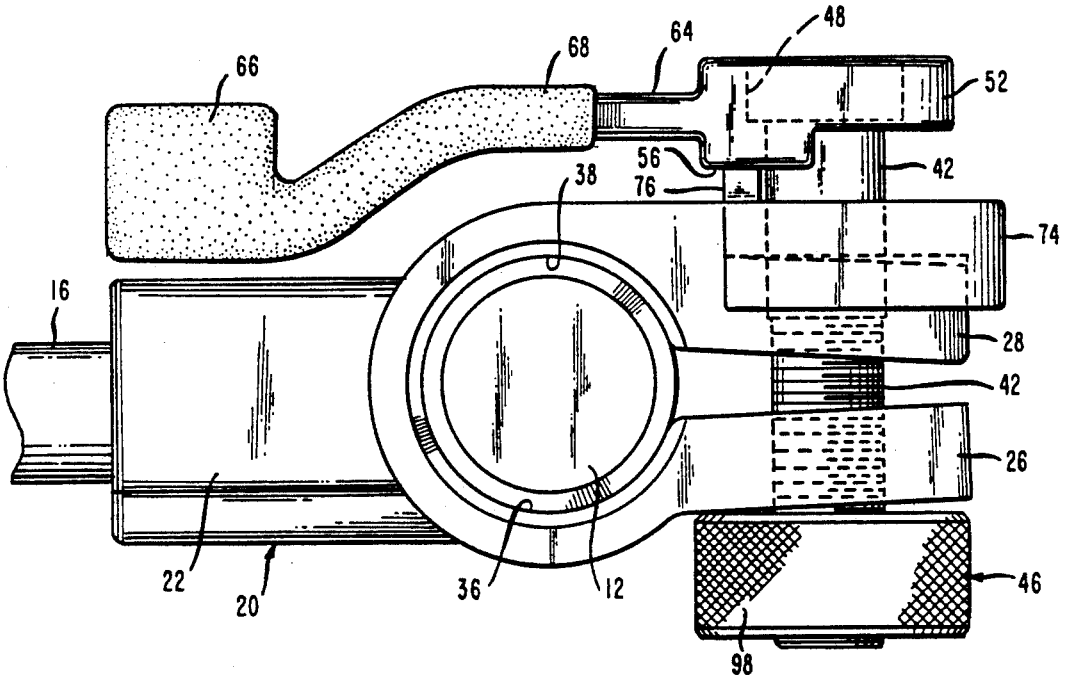
FIG. 3 is a plan view in a first, closed configuration.

The lever member 52 and fixed member 74 are positioned on the connecting shaft 42 such that the first inclined surface 56 and the second inclined surface 76 are juxtaposed and offset from the axis of rotation of the lever member 52. Rotation of the lever member 52 about the long axis of the connecting shaft 42 will cause sliding contact between the first inclined surface 56 and the second inclined surface 76, which will cause axial movement of the fixed member 74 from the lever member 52. The lever member 52 being fixed in position by the head 48 against reactive movement, the fixed member 74 will act against the second terminal connector flange 28 to compress the terminal connector flanges against the stop 46, and to press the terminal connector clamp 20 against the terminal post 12 (FIG. 3).

Figure 4:
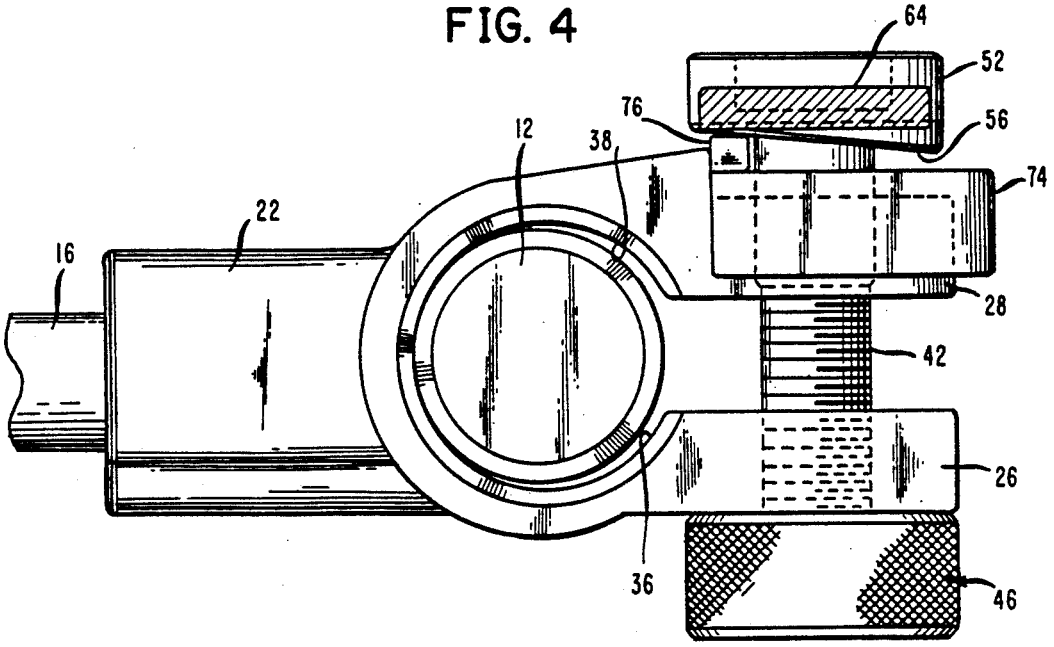
FIG. 4 is a plan view, partially broken away, of a second, open configuration.

Opposite rotation of the lever arm 64 will move the respective first and second inclined surfaces 56 and 76 away from one another (FIG. 4). This will permit movement of the fixed member 74 toward the lever member 52, and a relaxation of pressure on the second terminal connector flange 28 and the terminal post 12. The lever arm 64 can be rotated substantially 180 degrees away from the closed position depicted in FIG. 3, wherein the lever arm 64 can be manipulated to pry the terminal connector flanges apart.

The stop 46 can include a mounting aperture 88 which can have female threads 90. The connecting shaft 42 can have male threads 94, which are adapted to engage the female threads 90 on the stop member 46. In this manner, the stop member 46 can be threadably adjusted on the connecting shaft 42 to provide a coarse adjustment of the position of the stop member 46 relative to the connector flange 26. A knurled surface 98 can be provided on the stop member 46 to facilitate manipulation of the stop member 46. Also, the stop member 46 can be detached from the connecting shaft 42 to permit attachment and detachment of the invention to standard battery terminal clamps. An Allen wrench fitting 100, or other tool fitting, can be provided on an end of the connecting shaft 42 to permit detachment of the connecting shaft 42 and stop member 46, where the same have become frozen in place.

It is possible to provide the invention, as shown, in an add-on device suitable for modifying existing battery terminal connector clamps. The connecting shaft 42, stop member 46, lever member 52 and fixed member 74 can be added to the connector clamp 20 quickly and with no tools. It would alternatively be possible, however, to construct a terminal connector clamp 20 according to the invention. This integral construction could include the battery conductor cable. In this embodiment, the fixed member 74 could be cast integrally into or as a part of the second connector flange 28. Alternatively, the fixed member 74 could be otherwise fastened to the connector flange 28 by the manufacturer.

Generally, the fixed member 74 must be made of a more rigid material than lead to prevent marring of the second inclined surface 76 during use. The other components of the invention are preferably constructed of durable, rust-resistant materials such as stainless steel.

In operation, the stop member 46 is threadably rotated on the connecting shaft 42 to a position where it abuts an outside surface of the first terminal connector flange 26 (FIG. 4). The lever arm 64 will typically in this position be "up". The first inclined surface 56 and second inclined surface 76 will be substantially juxtaposed, but without making contact or with contact only between the narrow dimension of each inclined surface. Rotation of the lever arm 64 in the clockwise direction to a position substantially adjacent the terminal connector clamp 20 (FIG. 3) will cause sliding contact between the first inclined surface 56 and the second inclined surface 76. This will cause the fixed member 74 to move axially from the lever member 52. The first connector flange 26 and second connector flange 28 will thereby be pressed between the fixed member 74 and the stop member 46. The curvilinear surfaces 36, 38 will be pressed tightly against the terminal post 12 to firmly engage the connector clamp 20 to the terminal post 12.

When it is desired to remove the terminal connector clamp 20 from the terminal post 12, the lever arm is lifted to the position shown in FIG. 4. The first inclined surface 56 is rotated away from the second inclined surface 76, allowing the fixed member 74 to move axially toward the lever member 52. This will relax pressure on the first terminal connector flange 26 and second terminal connector flange 28, and thereby on the curvilinear surfaces 36, 38. The terminal connector can thereby be removed. The lever arm 64 can be utilized to pry apart the terminal connector flanges, if necessary. It will be appreciated that as the device becomes worn, the stop member 46 can be rotated tightly against the first connector flange 26 to adjust the gripping strength of the assembly.

Figure 5:
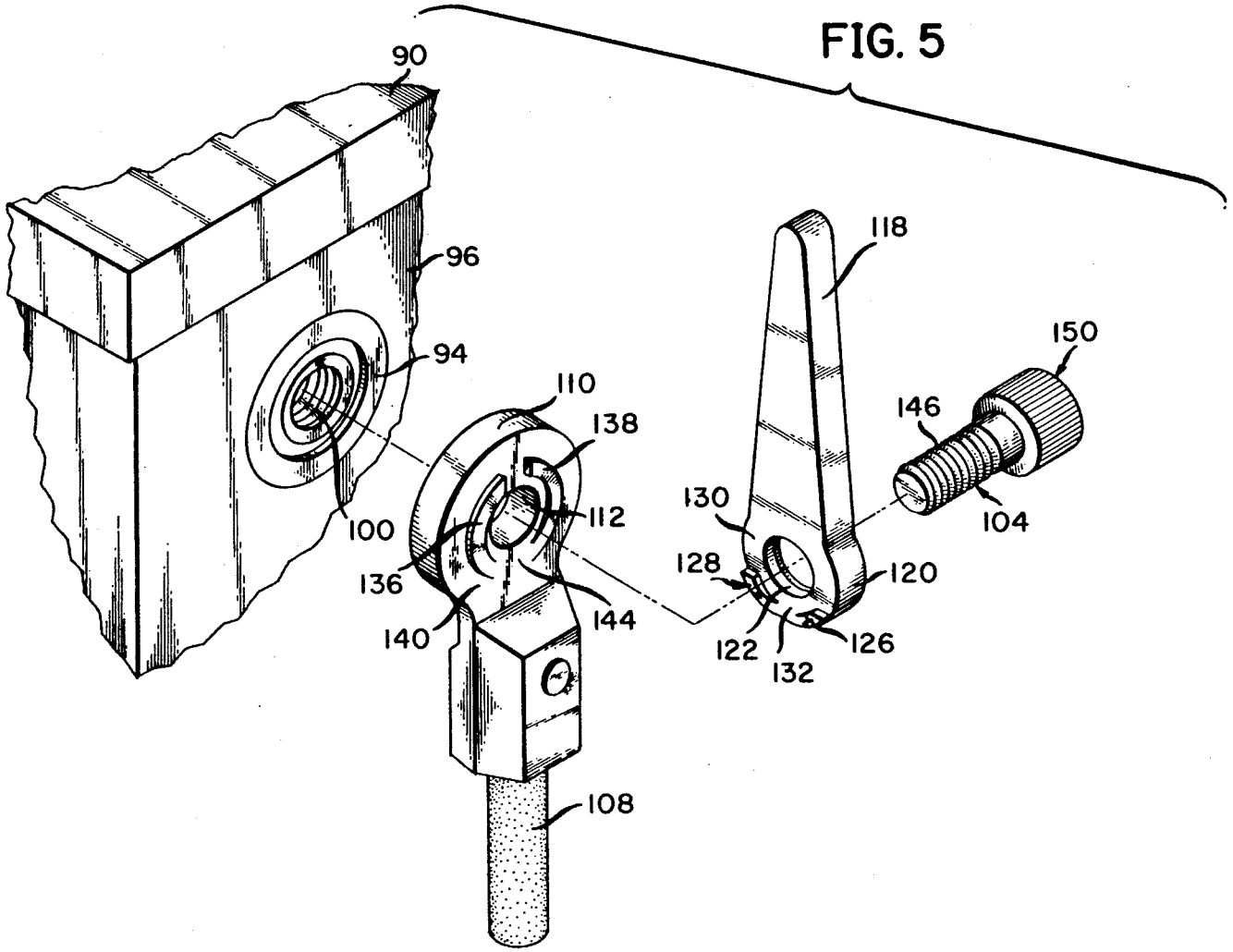
FIG. 5 is an exploded perspective view of a second embodiment for side post terminal batteries.
Figure 6:
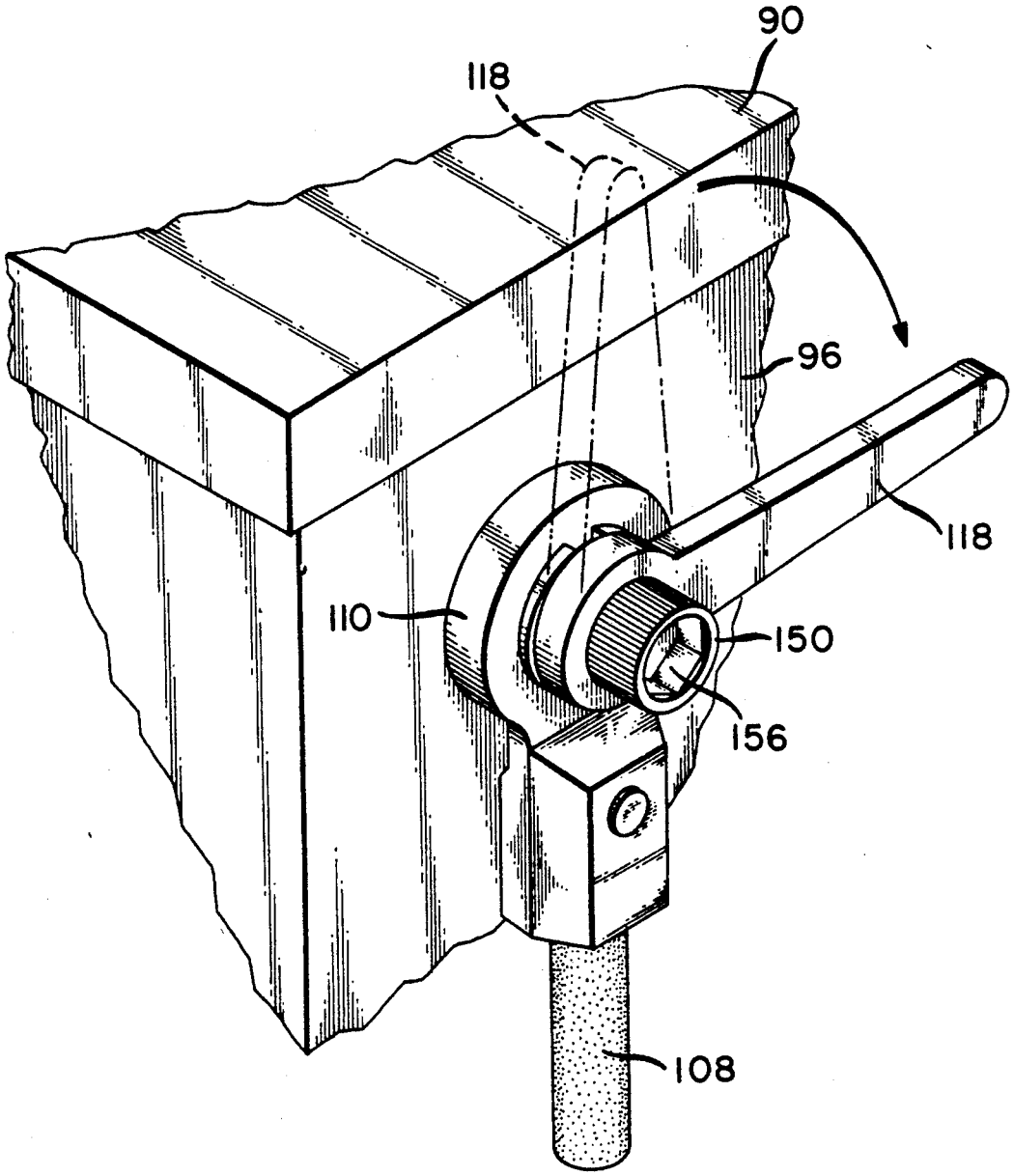
FIG. 6 is an assembled perspective.

A second embodiment of invention shown in FIGS. 5–6 is preferable for batteries having side post terminals. The battery 90 will have battery terminals 94 which are mounted at a side surface 96 of the battery 90. A female fitting 100 is provided to receive and engage, as by correspondingly threaded portions, a male connector member such as the bolt 104. The battery cable 108 has a battery cable terminal 110 with an aperture 112 that is dimensioned to permit the passage of the shaft of the bolt 104. The bolt 104 is threaded into the fitting 100 to firmly press the cable terminal 110 against the battery terminal 94. This construction often works loose over time, and the invention provides a convenient method for providing a secure connection.

A lever 118 is provided and has at an end 120 an aperture 122 that is dimensioned to permit the passage of the connector bolt 104. The lever 118 should preferably be insulating and, if made of a conductive material, should be covered by an insulating material such as plastic. At least one inclined surface, and preferably oppositely directed inclined surfaces 126, 128 are provided on a surface 130 of the lever 118. The inclined surfaces 126, 128 are preferably substantially concentrically disposed about the aperture 122. The inclined surfaces 126, 128 preferably slope outwardly from the surface 130, and from a bottom-most portion 132 which is substantially even with the surface 130. The battery cable terminal 110 is provided with at least one inclined surface, and preferably oppositely directed inclined surfaces 136, 138 on a surface 140 of the cable terminal 110. The inclined surfaces 136, 138 are preferably substantially concentrically disposed about the aperture 112. The inclined surfaces 136, 138 incline outwardly from the surface 140 of the cable terminal 110, and preferably from a portion 144 at a bottom-most portion of the cable terminal 110, which portion 144 is substantially even with the surface 140. The inclined surfaces 136, 138 of the battery cable terminal 110 can be formed integrally with the battery cable terminal 110 or can be provided on a separate wedge member adapted to engage the battery cable terminal 110.

During assembly, the shaft 146 of the bolt 104 is positioned through the aperture 122 of the lever 118 and the aperture 112 of the cable terminal 110, and engaged to the female fitting 100 of the battery terminal 94. A bolt head 150 of the bolt 104 is dimensioned so as to prevent the removal of the lever 118 and the cable terminal 110. The lever 118 and cable terminal 110 are positioned with the surfaces 130, 140 substantially juxtaposed. The lever 118 will be in an upright position as shown is phantom in FIG. 6 during this connection, such that the inclined surfaces 126, 128 of the lever 118 and the inclined surfaces 136, 138 of the battery terminal 110 will be angularly offset from one another, which will permit a close fit between the surface 130 of the lever 118 and the surface 140 of the cable terminal 110. The bolt 104 is tightened by hand to provide a coarse adjustment of the position of the lever 118 relative to the cable terminal 110. A socket head fitting 156 can be provided in the bolt head 150 to permit removal of the bolt 104 should it become frozen in the fitting 100 of the battery terminal 94.

Rotation of the lever 118 in either angular direction, such as the clockwise rotation shown in FIG. 6, will cause sliding contact between cooperating inclined surfaces of the lever 118 and cable terminal 110. The clockwise rotation shown in FIG. 6 will cause contact between the inclined surface 126 of the lever 118 and the inclined surface 136 of the cable terminal 110. This will firmly press the cable terminal 110 against the battery terminal 94 to insure a secure electrical connection.

This invention can be embodied in other specific forms without departing from the spirit or essential attributes thereof. The inclined surfaces can be shaped or dimensioned differently, for example, and the connections and positions among the various parts can be modified without departing from the principle of a rotating inclined surface and a fixed inclined surface that has been disclosed herein. Accordingly, reference should be had to the following claims, rather than to the foregoing specifications, as indicating the scope of the invention.

I claim:

1. A tool-free assembly for connecting battery cable terminals to batteries having side post terminals with female fittings, comprising:

a male connector member adapted for engagement to said female battery terminal fitting;

a lever member having substantially at one end thereof an aperture dimensioned to permit the passage of a portion of said male connector member, said lever member having a first inclined surface;

a battery cable terminal having an aperture dimensioned to permit the passage of a portion of said male connector member, and having a second inclined surface;

said male connector member being positionable through said apertures of said lever member and said battery cable terminal, and connectable to said female fitting of said battery terminal, to secure said battery cable terminal and said lever member in an abutting relation adjacent to said battery terminal with said inclined surfaces being substantially juxtaposed and angularly offset from one another, whereby rotation of said lever member relative to said battery cable terminal will cause sliding contact between said inclined surfaces and will move said battery cable terminal against said battery terminal.

2. The tool-free assembly of claim 1, wherein said lever member comprises two arcuate inclined surfaces sloping outwardly in opposite angular direction about said lever aperture, and said battery cable terminal comprises two arcuate inclined surfaces sloping outwardly in opposite angular directions about said battery cable terminal aperture, whereby opposing pairs of inclined surfaces on said lever member and said battery cable terminal will permit operation of said assembly with rotation of said lever member in either angular direction about said connector member.

3. A tool-free assembly for tightening terminal connectors on batteries having side post mount terminals, with each of said battery terminals having an aperture adapted for the reception of fastening means, said assembly comprising:

a connecting shaft having a long axis adapted for placement through said aperture, said connecting shaft having a first end adapted to engage said aperture of said battery terminal, and having at a second end a stop member;

a lever member rotatably connected to said second end of said connecting shaft and substantially abutting said stop member, said lever member having a first inclined surface;

a battery cable terminal having a base with a portion for electrically engaging a battery conductor cable and having a flange portion adapted to abut a surface of said battery terminal, said flange portion having a second inclined surface substantially juxtaposed to said first inclined surface of said lever member, whereby when said connecting shaft is secured to said battery terminal, rotation of the lever member about the connecting shaft and through a throw path of less than about ninety degrees, will cause sliding contact between the first inclined surface of the lever member and the second inclined surface of the battery cable terminal, and will cause axial movement of said flange portion along the long axis of the connecting shaft, to force said flange portion towards said battery terminal to secure said battery cable terminal to said battery terminal.

4. The tool-free assembly of claim 3, wherein said flange portion of said battery cable terminal comprises a mounting aperture for reception of said connecting shaft.

5. The tool-free assembly of claim 3, wherein at least one of said inclined surface on said lever member and said inclined surface on said flange portion is arcuate and substantially concentric with said connecting shaft.

6. A tool-free assembly for tightening battery cable terminals to batteries having side post mount terminals, said battery terminals having a surface adapted to receive a flange portion of said battery cable terminal, with each of said battery terminal and said flange portion having an aperture adapted for the reception of fastening means, said assembly comprising:

a connecting shaft having a long axis adapted for placement through said apertures, said connecting shaft having a first end adapted to fit into said aperture of said battery terminal, and to engage said battery terminal, and having at a second end a stop member;

a lever member rotatably connected to said second end of said connecting shaft and substantially abutting said stop member, said lever member having a first inclined surface;

a wedge member on an outside surface of said battery cable terminal adapted to be substantially juxtaposed to said lever member, said wedge member having a second inclined surface substantially juxtaposed to said first inclined surface of said lever member, whereby when said connecting shaft is secured to said battery terminal, rotation of the lever member about the connecting shaft and through a throw path of less than about ninety degrees, will cause sliding contact between the first inclined surface of the lever member and the second inclined surface of the wedge member, and will cause axial movement of said wedge member along the long axis of the connecting shaft, to force said flange portion towards said surface of said battery terminal to secure said battery cable terminal to said battery terminal.

7. The tool-free assembly of claim 6, wherein at least one of said inclined surface on said lever member and said inclined surface on said flange portion is arcuate and substantially concentric with said connecting shaft.

8. The tool-free assembly of claim 6, wherein said lever member comprises two arcuate inclined surfaces sloping outwardly in opposite angular direction about said lever aperture, and said wedge member comprises two arcuate inclined surfaces sloping outwardly in opposite angular directions about said battery cable terminal aperture, whereby opposing pairs of said inclined surfaces on said lever member and said wedge member will permit operation of said assembly with rotation of said lever member in either angular direction about said connecting shaft.

* * * * *